US008555765B2

(12) United States Patent
Graham, II et al.

(10) Patent No.: US 8,555,765 B2
(45) Date of Patent: Oct. 15, 2013

(54) SYSTEMS METHODS AND DEVICES FOR ATTACHING A SUPPRESSOR TO A FIREARM

(75) Inventors: Henry L. Graham, II, Salt Lake City, UT (US); William J. Ellison, Greer, SC (US)

(73) Assignee: Silencerco, LLC, West Valley City, UT (US)

( * ) Notice: Subject to any disclaimer, the term of this patent is extended or adjusted under 35 U.S.C. 154(b) by 178 days.

(21) Appl. No.: 13/329,195

(22) Filed: Dec. 16, 2011

(65) Prior Publication Data

US 2012/0180623 A1 Jul. 19, 2012

Related U.S. Application Data

(60) Provisional application No. 61/459,657, filed on Dec. 16, 2010.

(51) Int. Cl.
*F41A 21/00* (2006.01)

(52) U.S. Cl.
USPC ..... 89/14.4; 89/14.3; 285/92

(58) Field of Classification Search
USPC ..... 42/79; 89/14.1, 14.2, 14.3, 14.4, 14.5, 89/14.6; 285/92
See application file for complete search history.

(56) References Cited

U.S. PATENT DOCUMENTS

| | | | | |
|---|---|---|---|---|
| 2,852,983 | A * | 9/1958 | Netzer | 89/14.05 |
| 5,192,219 | A * | 3/1993 | Fowler et al. | 439/321 |
| 5,215,336 | A * | 6/1993 | Worthing | 285/81 |
| 5,882,044 | A * | 3/1999 | Sloane | 285/92 |
| 7,156,424 | B2 * | 1/2007 | McCord | 285/92 |
| 7,661,349 | B1 * | 2/2010 | Brittingham | 89/14.4 |
| 7,743,693 | B1 * | 6/2010 | Brittingham | 89/14.4 |
| 8,091,462 | B2 * | 1/2012 | Dueck et al. | 89/14.05 |
| 8,490,535 | B1 * | 7/2013 | Moore et al. | 89/14.2 |
| 2006/0060076 | A1 * | 3/2006 | Dueck et al. | 89/14.4 |

* cited by examiner

*Primary Examiner* — Gabriel Klein
(74) *Attorney, Agent, or Firm* — Ballard Spahr LLP

(57) ABSTRACT

The invention relates to devices for attaching or removing a sound suppressor or other auxiliary device to a firearm. The device has a mount body threadedly attachable to a muzzle attachment device attached to the muzzle of a gun. A locking spring extends around a portion of the mount body, and has serrated pawls for engaging a portion of the muzzle attachment device. An annular, rotatable locking collar attaches to the mount body and extends over the locking spring. As the locking collar is rotated, a reduction in diameter of the inner surface of the locking collar can urge the pawl into secured contact with the muzzle attachment device.

18 Claims, 7 Drawing Sheets

SYSTEMS METHODS AND DEVICES FOR ATTACHING A SUPPRESSOR TO A FIREARM

CROSS-REFERENCE TO RELATED APPLICATIONS

This application claims the benefit of U.S. Application No. 61/459,657, filed Dec. 16, 2010; which is hereby incorporated herein by reference in its entirety.

FIELD OF THE INVENTION

This invention relates to a sound suppressor or silencer for a firearm. More specifically, the invention relates to systems, methods and devices for attaching or removing a sound suppressor or other auxiliary device to a firearm.

BACKGROUND

A number of different mounting systems exist that allow attachment and removal of a sound suppressor to a muzzle area of a firearm. Systems used included coarse thread with ratchet-type secondary latch, bayonet-type push and twist, rotating eccentric opening collar with ratchet-type secondary latch, locking gate with spring biased secondary latch, spring-biased locking gate with rotating secondary latch, and locking gate with a pivoting secondary latch. Problems exist due to failures of the ratchet-type secondary retention system used with some of these systems. These problems include loosening of the sound suppressor, inconsistent re-positioning of the sound suppressor when re-attaching after removal, carbon build-up in the threaded area of the sound suppressor and the corresponding threaded area on the muzzle attachment device, an inability to remove the sound suppressor when required due to said carbon build-up, reliance on the carbon build-up to ensure that the suppressor locks up consistently, and inconsistency in the point-of-impact shift when the suppressor is attached to the host firearm. The variability in the point-of-impact shift is critical when used with precision shooting rifles due to the suppressor not locking up in the same position after removal and re-attachment. Any inconsistency in the point-of-impact shift at long ranges of engagement may mean the difference between hitting the target and missing the target.

U.S. Pat. No. 7,661,349 (Brittingham) disclosed a mounting system that features the use of a ratchet-type secondary retention system to secure the suppressor to the firearm after the suppressor has been screwed onto the firearm. U.S. Pat. No. 7,743,693 (Brittingham) disclosed a mounting system that features the use of a ratchet-type secondary retention system that uses two springs that are offset from each other in an attempt to reduce the problems of loosening. The latter patent ('693) disclosed a system that is for use with so-called 18 tooth mounts while the former patent ('349) is for use with so-called 51 tooth mounts. While the '693 patent with its dual secondary latch springs was intended to solve the problems of loosening of the suppressor, in reality the problem still exists. The '349 patent features much finer serrations on the flash hider but loosening still occurs, while both such systems still have other problems such as point-of-impact shift and carbon build-up. Part of the problem with the '349 patent is that the locking area of the ratchet-type system is somewhat small in size with only a few teeth that only locks up in one place or position on the flash hider.

Thus, there is a need in the pertinent art for methods, systems and devices for a suppressor that is easily securedly attachable to and detachable from a firearm, and that limits point-of-impact shift. The present invention fulfils these needs and provides further related advantages as describe herein.

SUMMARY OF THE INVENTION

In accordance with the purpose(s) of the invention, as embodied and broadly described herein, the invention, in one aspect, relates to firearms, and more specifically to systems, methods and devices for attaching or removing a sound suppressor or other auxiliary device to a firearm.

The present application provides a rotating cam collar locking system for a firearm suppressor that locks the suppressor securely to a muzzle attachment device or suppressor interface, has minimal point-of-impact shift on the host firearm, and minimizes the effect of carbon build-up upon the mounting system. The mounting system features a rotating locking collar that forces a locking spring with two pawls inwards and onto a coined or knurled shoulder that is part of the muzzle attachment device. The suppressor is screwed onto the muzzle attachment device until it is securely locked up and then the rotating locking collar is turned to lock the suppressor and the muzzle attachment device together, preventing the suppressor from moving during firing of the host weapon.

Also, disclosed is a mounting system for a suppressor that is fast, secure and has a minimal effect on point-of-impact shift on the host firearm. The mounting system comprises fitting a muzzle attachment device such as a flash hider or muzzle brake to the host firearm. This muzzle attachment device is the interface between the suppressor and the host firearm. No further changes or modifications to the host firearm are required once the suppressor interface has been fitted.

Also disclosed is a mounting system that allows for a decrease in the carbon buildup in the threaded area of the suppressor and the corresponding threaded area on the muzzle attachment device.

Also disclosed is a mounting system for a suppressor that has reduced thermal loading or coupling on a secondary retention system. Due to the design of a rotating locking collar and the positioning of a locking spring onto the muzzle attachment device, the locking spring of the secondary retention system contacts the muzzle attachment device in only two points when locked. The locking spring snaps into the mount externally to a mount body and is partially exposed to the air, reducing the thermal loading or coupling of the spring itself.

Also disclosed is a mounting system for a suppressor that allows for easy removal and replacement of the locking spring. As the locking spring simply snaps over the mount body, one screws the rotating locking collar forward until it cannot be rotated, then lever the locking spring out of the spring retaining groove in the mount body. This allows the operator or end user to remove and/or replace the locking spring easily.

Also disclosed are methods of using a mounting system for a suppressor that is fast, is secure and has a minimal effect on point-of-impact shift on the host firearm.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE FIGURES

A more complete understanding of the application can be obtained by reference to the accompanying drawings wherein generic parts of the illustrated matter are indicated by arrowhead lines associated with the designation numerals while specific parts are indicated by plain lines and wherein.

DETAILED DESCRIPTION

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a collar" can include two or more such collars unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

As used herein, the terms "forward" and "front" refers to the firing direction of the host rifle or suppressor (as shown in FIGS. 1-7 of the drawings as being on the right hand side of the drawings) while "rearward", "rear", and "behind" means the opposite direction from the firing direction (as shown in FIGS. 1-7 of the drawings as being on the left hand side of the drawings).

Figure 1:
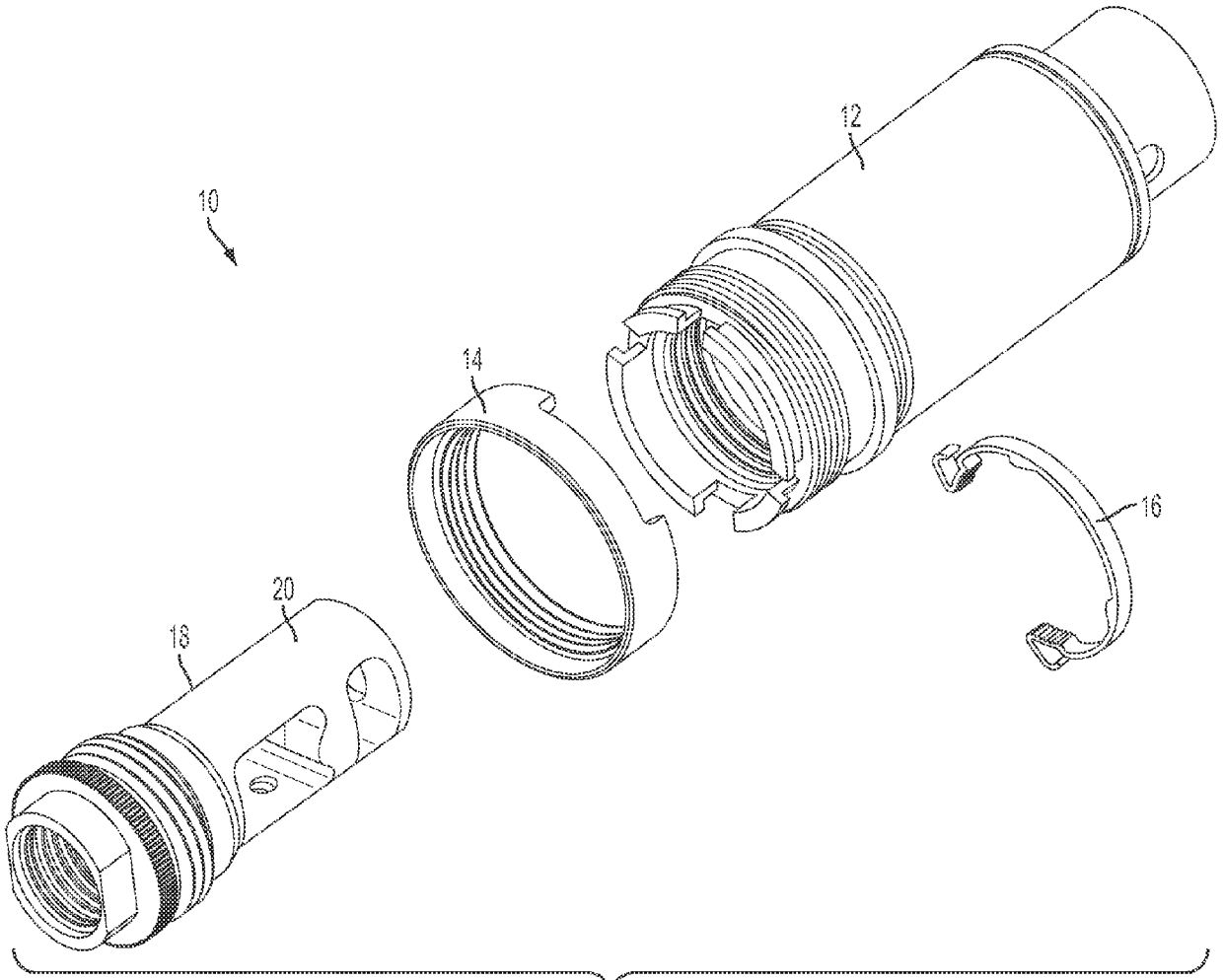
FIG. 1 is an isometric exploded view of a suppressor mount assembly, according to one aspect, comprising a muzzle attachment device, a mount body, a locking spring, and a rotating locking collar.

The application relates to methods, devices and systems for attaching or removing a sound suppressor or other auxiliary device to the muzzle area of a firearm. Referring in detail to FIG. 1 of the drawings, the suppressor mount assembly 10 is shown in a disassembled view. In one aspect, the suppressor mount assembly comprises at least one of a mount body 12 and a selectively locking assembly comprising a lock collar 14, and a locking spring 16. In another aspect, the suppressor mount assembly further comprises a muzzle attachment device 18. In FIG. 1, the muzzle attachment device comprises a muzzle brake 20, though a flash hider, a recoil compensator and the like can be used in place of the muzzle brake. In still another aspect, the selectively locking assembly can be configured to selectively prevent rotation of the mount body relative to the muzzle attachment device.

Figure 2:
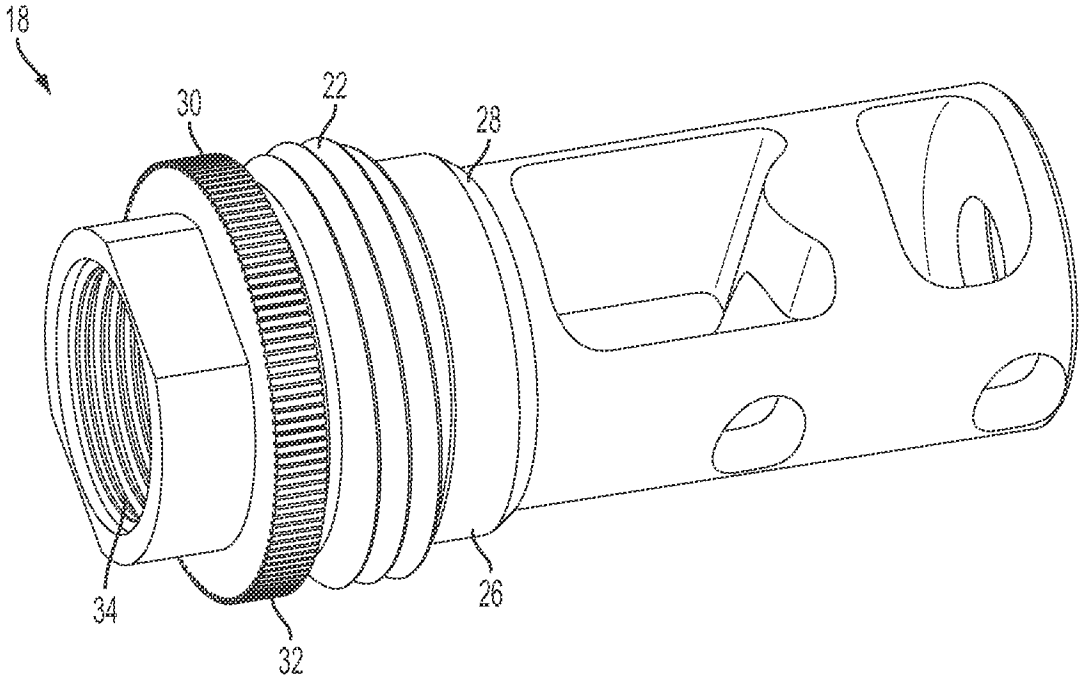
FIG. 2 is an isometric view of the muzzle attachment device of FIG. 1.

With reference to FIG. 2, a muzzle attachment device 18 comprising a muzzle brake 20 is shown. In one aspect, the muzzle attachment device has an external surface and defines a first bore extending between open first and second ends. In another aspect, the muzzle attachment device has external attachment mounting threads 22 defined in the external surface and configured to matingly interface with internal body threads 24 of the mount body 12 (illustrated in FIG. 3). An axial alignment surface 26 can be positioned forward of the attachment mounting threads and an attachment gas seal surface 28 can be positioned forward of the axial alignment surface. Rearward of the attachment mounting threads 22, a circumferential flange 30 can be positioned on the external surface. In one aspect, the circumferential flange can have a patterned surface on it. In another aspect, the patterned surface can be an external coin knurled surface defining a plurality of longitudinally extending retaining notches 32. In one aspect, the first bore has internal attachment threads 34 proximate the first end for selective attachment of the muzzle attachment device to the host firearm. In one aspect, a muzzle brake can be the muzzle attachment device (the interface between the host firearm and the suppressor). Optionally, in other aspects, the muzzle attachment device can be, for example and without limitation, a flash hider or a recoil compensator. In these aspects, the muzzle attachment device could still comprise external mounting threads 22, the axial alignment surface 26, the attachment gas seal surface 28 and the flange 30 with an external coin knurled surface.

Figure 3:
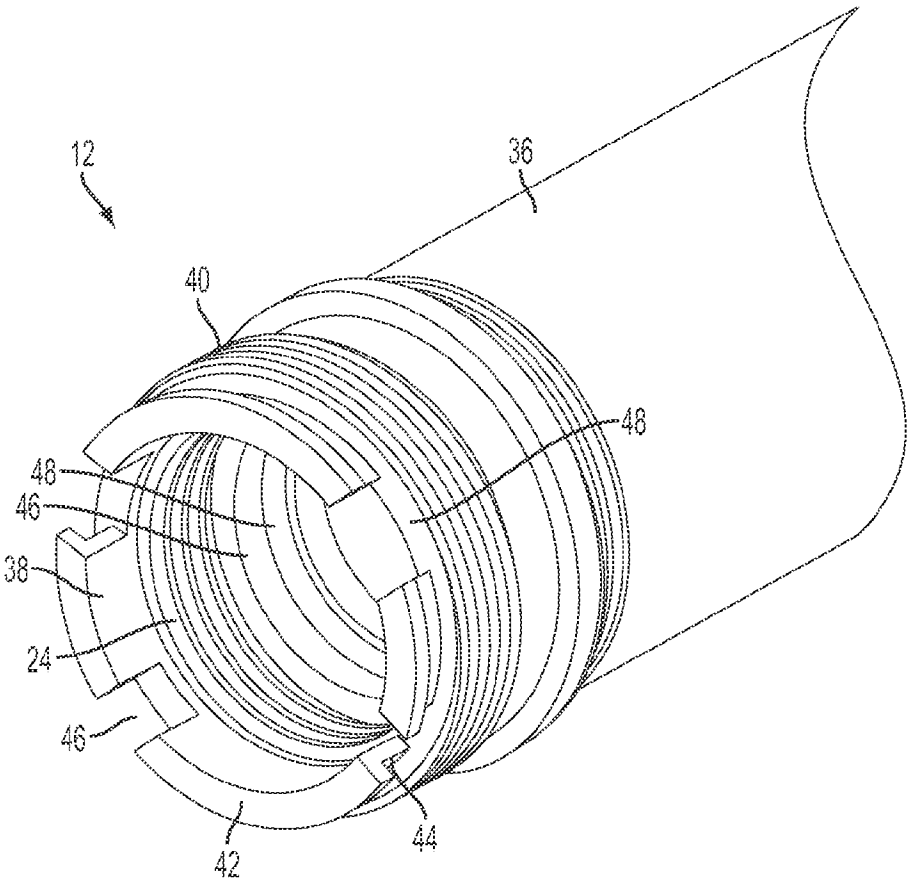
FIG. 3 is an isometric view of the mount body of FIG. 1.

Referring in detail to FIG. 3 of the drawings, the mount body 12 is shown. In one aspect, the mount body has an external body surface 36 and defines a second bore extending between open front and rear faces 42 that has an internal body surface 38. For example, the mount body can be substantially tubular in shape. In another aspect, the mount body has external body threads 40 defined in the external surface of the mount body and positioned a predetermined distance from a rear face 42 of the body. The external body threads can be configured for attachment to the rotating locking collar 14. In another aspect, forward of the rear face of the body and rearward of these external body threads is a spring retaining groove 44 defined in the mount body. The spring retaining groove can be a groove having a smaller outer diameter than adjacent portions of the mount body 12. In another aspect, a plurality of body notches or cutouts 46 can be defined on the rear face 42 of the mount body. For example the plurality of cutouts can be a pair of openings defined in the spring retaining groove. In one aspect, the body cutouts can extend through the rear face and the spring retaining groove and terminate at a forward or front surface 47 of the spring retaining groove 44. Internal body threads 24 can be defined in the internal surface 38 of the mount body 12 proximate the proximal end that is configured to selectively, matingly interface with the external attachment mounting threads 22 of the muzzle attachment device 18.

In one aspect, forward of the internal body threads 24 of the mount body 12 can be a body axial alignment surface 46 that corresponds with the axial alignment surface 26 of the muzzle attachment device 18. In another aspect, a body gas seal surface 48 can be positioned in front of the body axial alignment surface. In this aspect, when assembled as described below, the body gas seal surface can butt up against the attachment gas seal surface 28 of the muzzle attachment device 18 to form a gas seal, thus preventing expanding muzzle gases from the muzzle attachment device to reach the mounting threads when the suppressor is in use.

Figure 4:
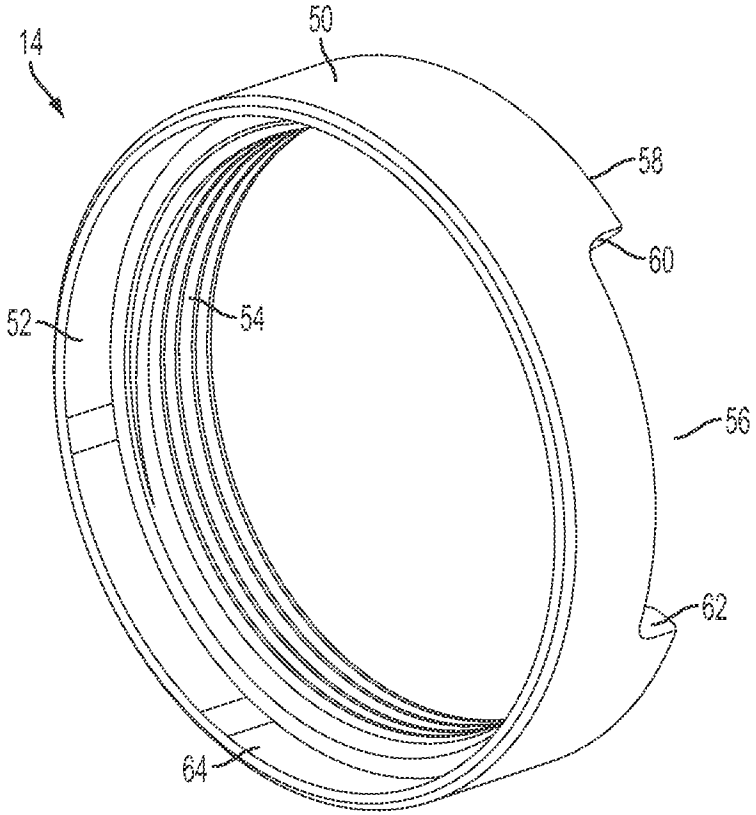
FIG. 4 is an isometric view of the rotating locking collar of FIG. 1.

Referring in detail to FIG. 4 of the drawings, the rotating locking collar 14 is shown. The locking collar can be an annular collar having an external collar surface 50 and an internal collar surface 52. In one aspect, the internal collar surface can have an inner collar diameter $D_C$. In another aspect, internal collar threads 54 can be defined in the internal collar surface. In this aspect, the internal collar threads can be configured to matingly engage the external body threads 40 of the mount body 12. In another aspect, a collar slot 56 can be defined in a portion of a forward edge 58 of the rotating locking collar. The collar slot can extend for a predetermined length between a pair of collar shoulders 60, 62.

In one aspect, a plurality of milled recesses 64 can be defined in the internal collar surface 52 of the rotating locking collar 14 rearward of the internal collar threads 54. For example, the milled recesses can comprise two milled recesses spaced from each other around the circumference of the inner diameter of the internal collar surface. In another aspect, each recess of the plurality of milled recesses 64 can have a diameter $D_R$ that is greater than the inner collar diameter $D_C$. Optionally, the plurality of milled recesses 64 can comprise two milled recesses that can be spaced from each other a predetermined distance. For example, in one aspect, the milled recesses can be positioned at the ten and two o'clock positions on the locking collar when viewed from the rear of the collar. In still another aspect, the portions of the internal collar surface 52 that do not form portions of the milled recesses are raised relative to the milled recesses and can form at least one locking lobe 65.

Figure 5:
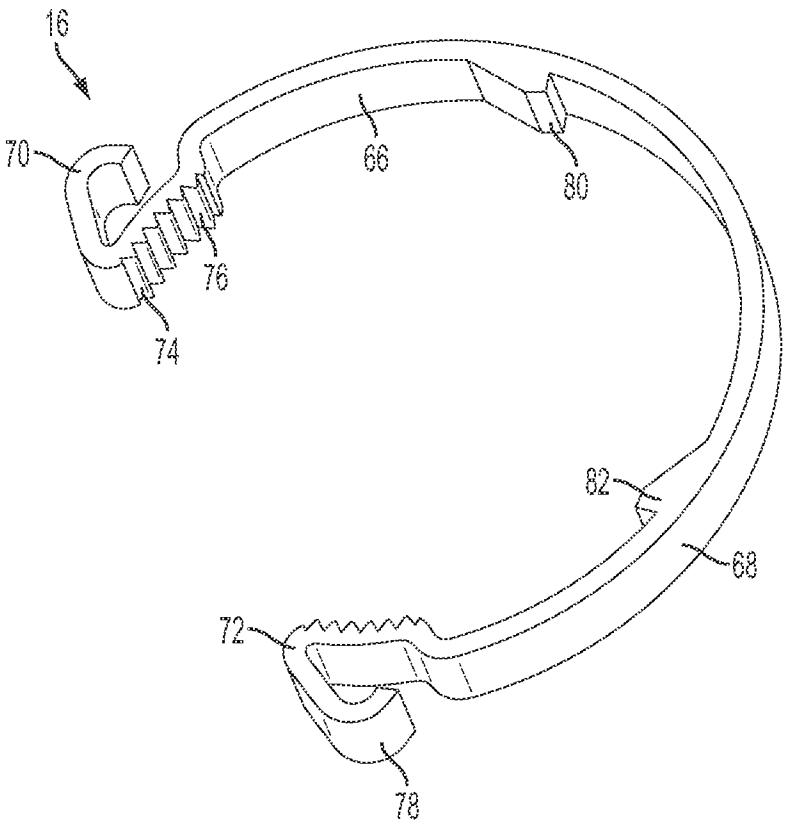
FIG. 5 is an isometric view of the locking spring of FIG. 1.

Referring in detail to FIG. 5 of the drawings, the locking spring 16 is shown. In one aspect, the locking spring can have an inner spring surface 66 and an outer spring surface 68, and can be positioned in a substantially arcuate shape having two pawls 70, 72 positioned at each end of the arc. For example and without limitation, the locking spring 16 can be substantially "C"-shaped. In another example, the locking spring can be substantially similar in shape to that of the Greek symbol Omega (Ω). In another aspect, serrations 74 can be defined in an inner pawl surface 76 of each of the pawls. In still another aspect, a locking collar interface 78 can be positioned on each pawl. The locking collar interface can be positioned on each pawl such that the locking collar interface can extend to a first predetermined distance beyond the outer spring surface 68 (the "unlocked position"). In still another aspect, the locking collar interface 78 can be configured to flex to a second predetermined distance beyond the outer spring surface 68 that is less than the first predetermined distance (the "locked position"). When assembled as part of the suppressor mount assembly 10, described more fully below, when the locking collar interface is in the unlocked position, the serrations 74 of each pawl are spaced from the retaining notches 32 of the muzzle attachment device 18. In the locked position, the locked spring is biased to a position in which the serrations of the locking spring are in contact with the retaining notches of the muzzle attachment device.

In one aspect, a pair of travel limiters 80, 82 or tabs can be positioned on the inner spring surface 66. In this aspect, the pair of travel limiters can be spaced a predetermined distance from each other. When assembled as part of the suppressor mount assembly 10, the pair of travel limiters can restrict rotational movement of the locking spring 16 when placed on the mount body 12 such that the locking spring can rotate about and between a first position, in which a first travel limiter 80 contacts an edge of a body cutout 46 of the mount body, and a second position, in which a second travel limiter 82 contacts an edge of a body cutout of the mount body. In another aspect, the travel limiters aid in positioning the locking spring correctly in the spring retaining groove 44.

Figure 6:
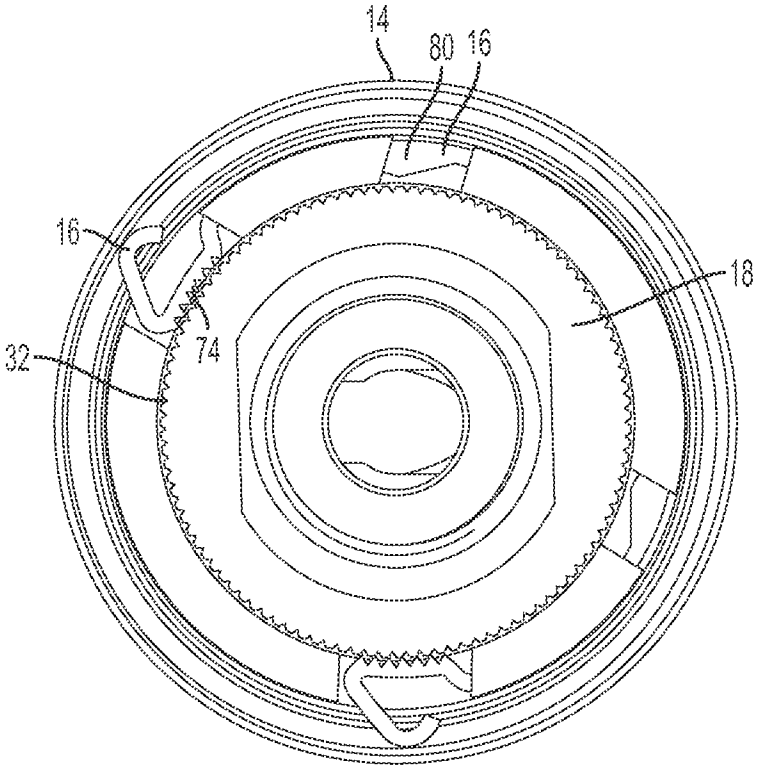
FIG. 6 is a rear view of the mount body and the muzzle attachment device with the locking spring in an unlocked position.

Referring in detail to FIG. 6 of the drawings, a rear end view of the suppressor mount assembly 10 with the muzzle attachment device 18 is shown with the locking spring 16 in an unlocked position, according to one aspect. The serrated surface 74 of the locking spring are shown slightly offset from the retaining notches 32 of the muzzle attachment device 18.

Figure 7:
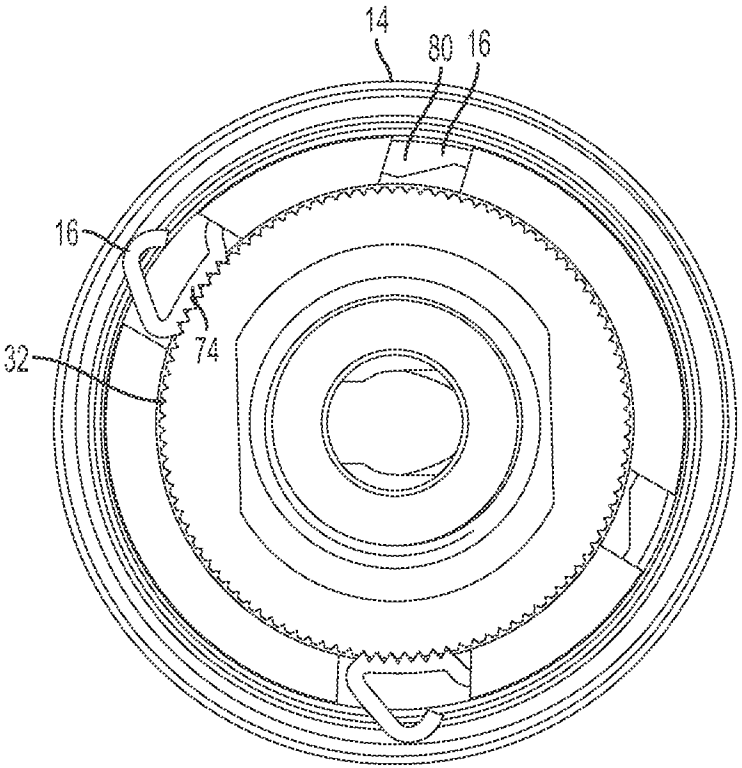
FIG. 7 is a rear view of the mount body and the muzzle attachment device with the locking spring in a locked position.

Referring in detail to FIG. 7 of the drawings, a rear end view of the suppressor mount assembly 10 with the muzzle attachment device 18 is shown with the locking spring 16 in a locked position, according to one aspect. The retaining notches 32 of the coined knurled surface on the muzzle attachment device are shown with the serrated surface 74 of the locking spring interfacing with the retaining notches of the muzzle attachment device, thereby locking the mount body 12 and the muzzle attachment device together.

In order to assemble the device, the locking spring 16 can be snapped into the spring retaining groove 44 of the mount body 12 such that at least a portion of the inner spring surface 66 is positioned adjacent to and at least partially surrounds the external body surface 36 of the spring retaining groove. The rotating locking collar 14 can be attached to the mount body by screwing the rotating locking collar onto the mount body so that the internal collar threads 54 of the rotating locking collar engage the external body threads 40 of the mount body. In one aspect, the locking collar can be sized to fit over and around the outer surface of the locking spring. In this position, the internal collar surface 52 of the rotating locking collar can contact at least portions of the locking collar interfaces 78 of the rotating locking collar.

Upon attachment of the rotating locking collar 14 to the mount body 12, to place the locking collar in a first, unlocked position (wherein the locking collar interface 78 extends a first predetermined distance beyond the outer spring surface 68), the rotating locking collar can be rotated about the longitudinal axis of the mount body until the milled recesses 64 of the locking collar are adjacent the locking collar interface 78 of each pawl 70, 72. Because the milled recesses have a diameter $D_R$ greater than the inner collar diameter $D_C$, the spring can expand slightly. When the rotating locking collar is rotated to a second, locked position so that the milled recesses of the mount body are spaced from the locking collar interface 78 (in one aspect, this can be approximately ⅛$^{th}$ of a revolution), the smaller internal diameter of the collar 14 (relative to the milled recess diameter) urges the locking spring pawls inwardly so that the locking collar interface 78 extends to the second predetermined distance beyond the outer spring surface 68, and the locking spring is now in a compressed or locked state. Thus, because the inner collar diameter $D_C$ can be less than the diameter $D_R$ of the milled recesses 64, as the rotating locking collar 14 is rotated, the locking spring pawls can expand away from the longitudinal axis of the mount body when the milled recesses are adjacent the locking collar interfaces 78, and can be urged inwardly toward the longitudinal axis of the mount body when the milled recesses are not adjacent the locking collar interfaces 78.

In an example, in the first, unlocked position, the milled recesses are adjacent to the locking collar interfaces of the locking spring, and the larger inner surface diameter of the milled recesses (relative to the unmilled collar inner diameter) allows the locking spring to expand slightly (to the first predetermined distance beyond the outer spring surface 68). Note that the inner surface of the milled recesses is urging the spring to the first position. In the second, locked position, the milled recesses are spaced from the locking collar interfaces, and the smaller inner surface diameter of the collar 14 (relative to the milled recess diameter) urges the locking spring to compress slightly (to the second predetermined distance beyond the outer spring surface 68).

To attach the suppressor mount assembly 10 to a firearm, the rotating locking collar 14 can be rotated to the unlocked position in which the milled recesses 64 of the mount body 12 are adjacent the locking collar interface 78 of each pawl 70, 72. This puts the locking spring into an "at rest" position. The mount body 12 can be screwed onto the muzzle attachment device 18 until it is unable to be rotated anymore by engaging the external attachment mounting threads 22 of the muzzle attachment device with the internal body threads 24 of the mount body 12 (the "primary retention system"). In one aspect, when the mount body and muzzle attachment device are coupled together, the cutout or openings of the mount body can be positioned in overlying registration with a portion of the patterned surface of the muzzle attachment device. After tightly screwing the mount body to the muzzle attachment device, the user can rotate the rotating locking collar 14 so that the milled recesses 64 of the mount body 12 are not adjacent the locking collar interface 78. The internal surface 52 of the rotating locking collar forces the locking collar interface 78 of the locking spring 16 inwards towards the longitudinal axis of the mount body so that the serrations 74 of the locking spring engage the notches 32 of the muzzle attachment device (the "secondary retention system"). This primary and secondary retention system lock the suppressor mount assembly 10 and the muzzle attachment device together in a secure manner. The muzzle attachment device 18 can be securedly attached to the firearm by engaging the internal attachment threads 34 of the muzzle attachment device with complementary threads on the firearm.

In use, the suppressor mount assembly 10 remains securedly locked to the muzzle attachment device 18, and doesn't loosen after usage. This is due to the locking surface area of the two pawls 70, 72 when locking occurs. Also, when the locking spring 16 is in its compressed (locked) position, the locking spring can exert an outward force on the locking collar 14 that reduces the possibility of the locking collar moving when in the locked position. This means that the locking spring can serve a dual function: locking the suppressor mount assembly 10 to the muzzle attachment device and keeping the rotating locking collar in the locked position.

In one aspect, when assembled as described herein and in use, the gas seal 28 of the muzzle attachment device 18 interfaces with the body gas seal surface 48 of the mount body. These seals can contact each other to at least partially restrict escape of gases through the threads on the muzzle attachment device and the threads of the mount body 12. As these two gas seal surfaces are positioned rear of any holes or slots in the muzzle attachment device, the expanding muzzle gases are restricted in their flow back towards the threads of the suppressor and muzzle attachment device, thereby preventing or reducing carbon build-up between the threads on the muzzle attachment device and the threads of the mount body.

In another aspect, when assembled as described herein and in use, the collar slot 56 of the rotating locking collar 14 exposes at least a portion of the locking spring 16 to the atmosphere. Further, the only contact between the locking spring and the muzzle attachment device occurs at the pawls 70, 72. These features can release heat from the suppressor and reduce thermal loading of the locking spring, thereby increasing the spring life.

If the locking spring 16 becomes damaged and needs to be replaced, the rotating locking collar 14 can be screwed forward until it is no longer able to be moved. In one aspect, this can expose the locking spring so that the locking spring can be levered out from the spring retaining groove 44 and then replaced by repeating the above steps in reverse.

With the locking spring 14 in the locked position, the suppressor mount assembly 10 is secured to the muzzle attachment device 10 in two places: the external attachment mounting threads 22 of the muzzle attachment device secured to the internal body threads 24 of the mount body 12 (the primary retention system) and the serrations 74 of the locking spring secured to the notches 32 of the muzzle attachment device (the secondary retention system). This combination results in a more secure mounting system than previous systems. Further, the increased interface area between the serrations of the locking spring and the notches 32 of the muzzle attachment device increase the security of the mounting system. This increased interface however, is small enough to limit heat transfer from the muzzle attachment device to the locking spring.

To remove the suppressor mount assembly 10 from a firearm, a user rotates the rotating locking collar 14 to the unlocked position, and then unscrews the suppressor mount assembly from the muzzle attachment device 18. Once the suppressor mount assembly is unscrewed from the muzzle attachment device, it is simply pulled forward and off the firearm.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A device for mounting a suppressor to a muzzle of a firearm, the device comprising:

a muzzle attachment device having an external surface and defining a first bore extending between open first and second ends, wherein the first bore has an internal thread formed proximate the first end that is configured for selective attachment to the muzzle, wherein the external surface defines an external mounting thread and a circumferential flange having a patterned surface proximate the first end of the muzzle attachment device;

a mount body having an external body surface and defining a second bore extending between open front and rear faces that has an internal body surface, wherein an internal thread is defined on a portion of the internal body surface proximate the proximal end that is configured to selectively matingly interface with the external mounting threads, wherein the external body surface defines an external body thread positioned a predetermined distance from the rear face of the mount body, wherein a spring retaining groove is defined in the external surface of the mount body between the rear face of the mount body and the external body threads, and wherein the spring retaining groove defines a pair of openings that are positioned in overlying registration with a portion of the patterned surface of the muzzle attachment device when the mount body and muzzle attachment device are coupled together; and a selectively locking assembly configured to selectively prevent rotation of the mount body relative to the muzzle attachment device, the locking assembly comprising:

an arcuate locking spring comprising a first end, an opposed second end, an inner spring surface and an outer spring surface, wherein the locking spring is sized so that the inner spring surface is in contact with and surrounds at least a portion of the spring retaining groove, wherein the locking spring comprises a pawl positioned at each of the first and second ends of the locking spring, each pawl having a locking collar interface and being configured to be movably received in a respective one of the openings in the spring retaining groove, and wherein the locking spring is biasable about and between an unlocked position in which the pawls are operatively spaced from the patterned surface of the muzzle attachment device, and a locked position in which at least a portion of the locking spring is in contact with portions of the patterned surface of the muzzle attachment device; and an annular locking collar having an external collar surface and an internal collar surface having an inner collar diameter, wherein internal collar threads are defined in the internal collar surface that are configured to matingly engage the external body threads of the mount body, wherein a plurality of milled recesses are defined in the internal collar surface rearward of the internal collar threads, and wherein each recess of the plurality of milled recesses has a recess diameter that is greater than the inner collar diameter, wherein the locking collar is rotatable about and between a first position, in which an inner surface of the milled recesses of the locking collar are adjacent the locking collar interfaces of the locking spring and the inner surface of the milled recesses urges the locking spring to the unlocked position, and a second position, in which the inner surface of the milled recesses of the locking collar are spaced from the locking collar interfaces of the locking spring and the inner surface of the locking collar urges the locking spring to the locked position.

2. The device of claim 1, wherein the muzzle attachment device further comprises an attachment gas seal surface positioned forward of the external mounting threads.

3. The device of claim 2, wherein the mount body further comprises a body gas seal surface positioned forward of the internal body threads, and wherein the body gas seal surface is configured to interface with the attachment gas seal surface of the muzzle attachment device to limit muzzle gases from the firearm reaching the internal body threads of the mount body.

4. The device of claim 1, wherein the patterned surface of the muzzle attachment device comprises a plurality of longitudinally extending retaining notches.

5. The device of claim 4, wherein a plurality of serrations are defined in an inner pawl surface of each of the pawls, wherein the locking collar interfaces are formed on an outer surface of each pawl, and wherein the locking spring is biasable about and between an unlocked position in which the serrations of the locking spring are spaced from the retaining notches of the muzzle attachment device, and a locked position in which the serrations of the locking spring are in contact with the retaining notches of the muzzle attachment device.

6. The device of claim 4, wherein the locking spring further comprises at least one travel limiter formed on the inner spring surface, and wherein the at least one travel limiter is configure to engage a shoulder of an opening of the pair of openings.

7. The device of claim 1, wherein the rotating locking collar further comprises a means for releasing heat from the locking spring.

8. The device of claim 7, wherein the means for releasing heat from the locking spring comprises a collar slot defined in and extending between two shoulders formed in a forward edge of the rotating locking collar.

9. The device of claim 1, wherein rotation of the rotating locking collar about one-eighth of a revolution biases the locking spring from the unlocked position to the locked position.

10. The device of claim 1, wherein the locking spring is substantially "C" shaped.

11. The device of claims 1, wherein the locking spring is substantially "Ω" shaped.

12. A device for mounting a suppressor to a muzzle attachment device attached to a muzzle of a firearm, the muzzle attachment device having external mounting threads, and a flange having a patterned external surface, the device for mounting a suppressor comprising:

a mount body comprising an external body surface and an internal body surface, wherein internal body threads are defined in the internal body surface of the mount body configured to matingly interface with the external mounting threads of the muzzle attachment device, wherein external body threads are defined in the external surface of the mount body and positioned a predetermined distance from a rear face of the mount body, and wherein a spring retaining groove is defined in the external surface of the mount body between the rear face of the mount body and the external body threads; and a secondary retention system comprising:

an arcuate locking spring comprising a first end, an opposed second end, an inner spring surface and an outer spring surface, wherein the locking spring is sized so that the inner spring surface is in contact with and surrounds at least a portion of the spring retaining groove, wherein the locking spring comprises a pawl positioned at each of the first and second ends of the locking spring, wherein a plurality of serrations are defined in an inner pawl surface of each of the pawls, wherein a locking collar interface is formed on an outer surface of each pawl, and wherein the locking spring is biasable about and between an unlocked position in which the serrations of the locking spring are spaced from the patterned surface of the muzzle attachment device, and a locked position in which the serrations of the locking spring are in contact with the patterned surface of the muzzle attachment device; and an annular locking collar having an external collar surface and an internal collar surface having an inner collar diameter, wherein internal collar threads are defined in the internal collar surface configured to matingly engage the external body threads of the mount body, wherein a plurality of milled recesses are defined in the internal collar surface rearward of the internal collar threads, and wherein each recess of the plurality of milled recesses has a recess diameter that is greater than the inner collar diameter, wherein the locking collar is rotatable about and between a first position, in which an inner surface of the milled recesses of the locking collar are adjacent the locking collar interfaces of the locking spring and the inner surface of the milled recesses urges the locking spring to the unlocked position, and a second position, in which the inner surface of the milled recesses of the locking collar are spaced from the locking collar interfaces of the locking spring and the inner surface of the locking collar urges the locking spring to the locked position.

13. The device for mounting a suppressor of claim 12, further comprising a means for reducing carbon build-up between the external mounting threads of the muzzle attachment device and the internal body threads of the mount body.

14. The device for mounting a suppressor of claim 13, wherein the means for reducing carbon comprises an attachment gas seal surface positioned on the muzzle attachment device, and a body gas seal surface on the mount body, and wherein the body gas seal surface is configured to interface with the attachment gas seal surface of the muzzle attachment device to limit muzzle gases from the firearm reaching the internal body threads.

15. The device for mounting a suppressor of claim 12, further comprising a means for reducing thermal loading of the secondary retention system.

16. The device for mounting a suppressor of claim 15, wherein the means for reducing thermal loading comprises exposing at least a portion of the locking spring to the atmosphere.

17. The device for mounting a suppressor of claim 16, wherein the means for reducing thermal loading further comprises limiting the contact area between the locking spring and the muzzle attachment device.

18. A method for mounting a suppressor to a muzzle of a firearm, the method comprising:

providing a suppressor mounting device comprising:

a muzzle attachment device comprising internal threads for selective attachment of the muzzle attachment device to the firearm, external mounting threads, and a flange having a patterned external surface;

a mount body comprising an external body surface and an internal body surface, wherein internal body threads are defined in the internal body surface of the mount body configured to matingly interface with the external mounting threads of the muzzle attachment device, wherein external body threads are defined in the external surface of the mount body and positioned a predetermined distance from a rear face of the mount body, and wherein a spring retaining groove is defined in the external surface of the mount body between the rear face of the mount body and the external body threads;

an arcuate locking spring comprising a first end, an opposed second end, an inner spring surface and an outer spring surface, wherein the locking spring is sized so that the inner spring surface is in contact with and surrounds at least a portion of the spring retaining groove, wherein the locking spring comprises a pawl positioned at each of the first and second ends of the locking spring, wherein a plurality of serrations are defined in an inner pawl surface of each of the pawls, wherein a locking collar interface is formed on an outer surface of each pawl, and wherein the locking spring is biasable about and between an unlocked position in which the serrations of the locking spring are spaced from the patterned surface of the muzzle attachment device, and a locked position in which the serrations of the locking spring are in contact with the patterned surface of the muzzle attachment device; and an annular locking collar having an external collar surface and an internal collar surface having an inner collar diameter, wherein internal collar threads are defined in the internal collar surface configured to matingly engage the external body threads of the mount body, wherein a plurality of milled recesses are defined in the internal collar surface rearward of the internal collar threads, and wherein each recess of the plurality of milled recesses has a recess diameter that is greater than the inner collar diameter, wherein the locking collar is rotatable about and between a first position, in which an inner surface of the milled recesses of the locking collar are adjacent the locking collar interfaces of the locking spring and the inner surface of the milled recesses urges the locking spring to the unlocked position, and a second position, in which the inner surface of the milled recesses of the locking collar are spaced from the locking collar interfaces of the locking spring and the inner surface of the locking collar urges the locking spring to the locked position;

attaching the muzzle attachment device to the firearm;

rotating the rotating locking collar to the first position in which the locking spring is in the unlocked position;

attaching the mount body to the muzzle attachment device by engaging the external mounting threads of the muzzle attachment device with the internal body threads of the mount body; and rotating the rotating locking collar to the second position in which the locking spring is in the locked position.

* * * * *